US012339090B2

(12) United States Patent
Mirzoev

(10) Patent No.: US 12,339,090 B2
(45) Date of Patent: Jun. 24, 2025

(54) DEVICE FOR FIXATION OF TENSION OF RESILIENT ELEMENTS OF A COMPOUND BOW

(71) Applicant: Rustam G. Mirzoev, Sunzha (RU)

(72) Inventor: Rustam G. Mirzoev, Sunzha (RU)

( * ) Notice: Subject to any disclaimer, the term of this patent is extended or adjusted under 35 U.S.C. 154(b) by 0 days.

(21) Appl. No.: 18/717,365

(22) PCT Filed: Jul. 8, 2022

(86) PCT No.: PCT/RU2022/050217
§ 371 (c)(1),
(2) Date: Jun. 6, 2024

(87) PCT Pub. No.: WO2023/106967
PCT Pub. Date: Jun. 15, 2023

(65) Prior Publication Data

US 2025/0060185 A1 Feb. 20, 2025

(30) Foreign Application Priority Data

Dec. 9, 2021 (RU) ..... RU2021136224

(51) Int. Cl.
*F41B 5/10* (2006.01)
*F41B 5/14* (2006.01)

(52) U.S. Cl.
CPC ..... *F41B 5/105* (2013.01); *F41B 5/1469* (2013.01)

(58) Field of Classification Search
CPC .... F41B 5/10; F41B 5/105; F41B 5/14; F41B 5/1469
USPC ..... 124/25.6, 86, 900
See application file for complete search history.

(56) References Cited

U.S. PATENT DOCUMENTS 4,294,221 A * 10/1981 Bryant ..... F41B 5/10 124/900
4,471,747 A * 9/1984 Nishioka ..... F41B 5/105 124/88
4,886,039 A * 12/1989 Wagner ..... F41B 5/10 124/900
4,887,582 A * 12/1989 Chattin ..... F41B 5/105 124/900

(Continued)

FOREIGN PATENT DOCUMENTS

CN 106403704 A * 2/2017 ..... F41B 5/10
RU 2026528 C1 * 1/1995 ..... F41B 7/04
RU 2734084 C1 * 10/2020 ..... A63B 65/02

*Primary Examiner* — Alexander R Niconovich
(74) *Attorney, Agent, or Firm* — Lawrence G. Fridman, Esq; FEIGIN & FRIDMAN, LLC

(57) ABSTRACT

A tension fixation device for a compound bow. The tension fixation device includes an engagement device, a hitch lock, and a retainer stopper. The engagement device is formed as a disk, fixed to pulleys of the compound bow, and rotatable therewith. The disk includes a recess and a protrusion. The hitch lock is configured, during tensioning of the compound bow, to engage and disengage from the engagement device. Upon storing a desired tension in a resilient element of the compound bow, the hitch lock is configured to engage the recess in the engagement device thereby to prevent rotation of the pulleys to release the tension in the bow. The retainer stopper is mounted onto the body of the bow, and is configured to prevent motion of the hitch lock, until the retainer stopper is released.

10 Claims, 7 Drawing Sheets

(56) References Cited

U.S. PATENT DOCUMENTS

| | | | | | |
|---|---|---|---|---|---|
| 5,060,626 | A * | 10/1991 | Elliott | F41B 5/1434 | 124/900 |
| 5,092,309 | A * | 3/1992 | Beaton | F41B 5/10 | 124/900 |
| 5,546,924 | A * | 8/1996 | Todd | F41B 5/1469 | 124/31 |
| 5,950,609 | A * | 9/1999 | Thielen | F41B 5/10 | 124/25.6 |
| 5,967,131 | A * | 10/1999 | Hervig | F41B 5/1403 | 124/25.6 |
| 6,032,660 | A * | 3/2000 | Hervig | F41B 5/105 | 124/900 |
| 7,637,256 | B2 * | 12/2009 | Lee | F41B 5/10 | 124/25.6 |
| 8,266,933 | B2 * | 9/2012 | Bishir, Jr. | F41B 5/14 | 70/61 |
| 8,347,664 | B2 * | 1/2013 | Bishir, Jr. | E05B 67/24 | 70/61 |
| 8,505,523 | B1 * | 8/2013 | Horn | F41B 5/1449 | 124/1 |
| 8,893,694 | B1 * | 11/2014 | DeBole | F41B 5/10 | 124/25.6 |
| 9,518,798 | B1 * | 12/2016 | Farren | F41B 5/10 | |
| 9,964,379 | B2 * | 5/2018 | Farren | F41B 5/1403 | |
| 10,473,417 | B1 * | 11/2019 | Peacemaker | F41B 5/10 | |
| 10,641,577 | B1 * | 5/2020 | Archer | F41B 5/1469 | |
| 11,029,120 | B2 * | 6/2021 | Peacemaker | F41B 5/1469 | |
| 11,073,355 | B1 * | 7/2021 | Flores, Jr. | F41B 5/105 | |
| 2013/0061839 | A1 * | 3/2013 | Asherman | F41B 5/10 | 124/31 |
| 2017/0122695 | A1 * | 5/2017 | Yehle | F41B 5/1469 | |

* cited by examiner

DEVICE FOR FIXATION OF TENSION OF RESILIENT ELEMENTS OF A COMPOUND BOW

FIELD OF THE TECHNOLOGY

The invention relates in general to parts of compound bows, specifically it relates to devices for fixation of tension of resilient elements of a compound bow.

BACKGROUND OF THE INVENTION

Invented in the late 60s of the last (twentieth) century in the USA, the compound bow quickly gained recognition among competitive shooters and hunters.

Compared to traditional bows, which have changed little over the twelve thousand years of their history, the new type of ancient throwing weapon has a number of undeniable advantages that have made it possible to significantly improve, in the language of military reference books, its tactical and technical characteristics.

Russian Patent RU 2499969 discloses a compound bow including its components and basic principles of operation.

Among the main advantages of the compound bows are:

- increased shooting accuracy with a higher initial speed of arrow flight and less fatigue of the shooter,
- small dimensions,
- simplified storage conditions, since the bow does not need to be disassembled after training; it can be stored in the assembled condition.

A disadvantage of the known compound bows (BL) is lack of means of fixation of tension of their resilient elements (UE), which ensure long-term retention of resilient ends of a compound bow in a tense position, and which relieve the load on the shooter's muscles from aiming until the shot can be fired.

U.S. Pat. Nos. 5,546,924 and 7,946,282 teach how to relieve the load on the shooter's muscles when installing a compound bow (BL) on a crossbow stock, equipped with a hook type sear with a trigger for holding the bowstring and the associated ends of the resilient elements of compound bows in a tense position.

However, this arrangement significantly changes the shape of the compound bow (BL), increases the weight and size characteristics, and reduces application of its use for hunting. Further, in the sport applications, the possibility of participating in archery competitions is excluded.

It is therefore desirable to create a tension fixation device/(UFN) of the resilient elements/(UE) of a compound bow/(BL) without increasing the applicable weight and size characteristics and without changing its functional purpose in general, and specifically without turning the bow into a crossbow. To the best of the inventor's knowledge, such devices have been disclosed by the prior art.

OBJECTS OF THE INVENTION

Among the main objects of the invention is to create a previously unknown device for fixating tension/(UFN) of resilient elements (UE) of a compound bow (BL) without changing its functional purpose in general, and specific ally without turning the bow into a crossbow.

The technical result is achieved in the invention by providing the device for fixation of tension (UFN) of the resilient elements (UFN UE) of a compound bow (BL) which reduces the shooter's fatigue and increases the accuracy of throwing the arrows. This occurs by means of fixation and keeping the resilient elements (UE) of the compound bow (BL) in the tense position for a long time before firing without using the hands of a shooter.

SUMMARY OF THE INVENTION

In the invention the above-noted objects are substantially achieved by the tension fixation device (UFN) of the resilient elements (UE) of the compound bow (BL) which comprises an engagement device for installation on tension pulley blocks (BNS) of the bow and a hitch lock (FZ), wherein a retainer stopper (SF) is provided for installation at the ends of the non-deforming bow body.

The specified elements of the tension fixation device (UFN), namely the engagement device (ZU) and the hitch lock (FZ) are provided with the possibility of their sequential engagement and release when the tension pulley blocks (BNS) rotate in one angular direction of the tension of the free ends of resilient elements/(UE) of the compound bow (BL). For this purpose, the engagement device (ZU) is equipped with engage and a release element or pin, and the hitch lock (FZ) is provided with a retainer stopper (SF) 4 for blocking the clamp/latch in the tensioned position of the resilient elements (UE) of the compound bow (BL).

Providing the tension fixation device (UFN) with the engagement device (ZU) for installation on the tension pulley blocks (BNSh) of the bow and providing a hitch lock (FZ) with a retainer stopper (SF) at the ends of the non-deformable bow body allow to engage the rotating tension pulley blocks (BNSh) with the bow body and to stop its rotation at the tensioned position of the resilient elements (UE).

Fixation or locking of the tension of the resilient elements (UE) also makes it possible to secure the potential energy of the resilient elements UE sufficient for throwing arrows at a predetermined distance with a given coefficient of their dissipation under the force of gravity.

This eliminates the need for the shooter to hold the compound bow (BL) bowstring while aiming. Further eliminating the need to hold the bowstring while aiming also eliminates the force load of the bowstring on the shooter's muscles.

Elimination of forceful loads on the shooter's muscles during aiming also eliminates influence of the tremors of tense muscles on the tension force of the resilient elements (UE) and improves aiming accuracy and the energy of arrows throwing.

Construction of the engagement device (ZU) and the hitch lock (FZ) with the possibility of their sequential engagement and release when the pulley blocks (BNS) rotate in one angular direction of the tension of the free ends of resilient elements (UE) allows, after aiming the arrow at the center of the target and without taking the shooter's hand off the string with the arrow, to throw the latter with constant energy by tensioning the string at the moment of shotting.

The above-discussed advantages of the tension fixation device (UFN) of the resilient elements (UE) make it possible to achieve the stated technical result and enable the user to increase the accuracy of throwing arrows of the compound bow (BL), without increasing its weight and size characteristics and without changing its functional purposes, and namely without turning the bow into a crossbow.

BRIEF DESCRIPTION OF DRAWINGS

The essence of the invention is illustrated by the drawings presented in FIGS. 1-11.

FIGS. 1A-1D illustrate an example of the design of a tension fixation_device (TFN) of resilient/flexible elements (UE) of a compound bow with the hitch lock (FZ) in the form of a spring-loaded latch (PPZ), wherein:

FIG. 1A is a view of the tension fixation device (UFN) from one side;

FIG. 1B is a top view of the tension fixation device (UFN);

FIG. 1C is a view of the hitch lock (FZ) from one side; and

FIG. 1D is a top view of the hitch lock (FZ).

FIGS. 2A-2D are the drawing illustrating an example of the design of the tension fixating device (UFN) of flexible elements (UE) of a compound bow with the hitch lock (FZ) in the form of a spring-loaded pivot arm (PPR), wherein:

FIG. 2A is a side view of the tension fixation device (UFN);

FIG. 2B is a top view of the tension fixation device (UFN);

FIG. 2C is a view of the spring-loaded pivot arm (PPR) from the side and along the line A; and FIG. 2D is a top view of the hitch lock (FZ) along the line B.

In FIGS. 1-11 the reference numerals indicate as follows:

1 is the tension fixation device (UFN) of flexible elements (UE) of a compound bow, connected in rotation to a block of drive pulleys (BPSH) of the bow, fixed stationary both on the axis of rotation and relative to each other.

2 is the engagement device (ZU) for fixation and releasing the tension of the resilient elements (UE);

- 2.1 is an engaging member or a recess on the engagement device (ZU) for fixation of the tension of the resilient elements (UE); and
- 2.2 is a release or a protrusion on the engagement device (ZU) for unlocking the engagement member 2.1.

3 is a hitch lock (FZ);

3.1 is a hitch lock FZ in the form of a spring-loaded rotary lever or a rotary arm (PPR) pivotally mounted at the rigid end of the bow body;

- 3.1.1 is fixating end of the spring-loaded pivot arm (PPR);
- 3.1.2 is a rotation axis of the spring-loaded pivot arm (PPR);
- 3.1.3 is power spring-drive of the spring-loaded pivot arm;

3.2 is the hitch lock FZ in the form of a spring-loaded latch (PPZ);

- 3.2.1 is a frame of the spring-loaded latch (PPZ);
- 3.2.2 is a slide latch;
- 3.2.3 is a through hole in the slide latch 3.2.2;
- 3.2.4 is a through hole in the frame 3.2.1; and
- 3.2.5 is a power spring and a gate actuator.

4 is a retainer stopper (SF) or a locking mechanism for holding the hitch lock (FZ) in a disabled state;

- 4.1 is a is retractable pin (SHB);
- 4.2 is a power spring of a retractable pin (SHV); and
- 4.3 is a traction ring for connecting the lock release cable.

5 is a block of drive pulleys (BPSh) for tensioning the bowstring and cables of resilient/flexible elements (UE) of the bow;

5.1 is an axis of joint rotation of a block of drive pulleys (BPSh) 5 and the engagement device (ZU) 2 rigidly fastened together;

5.2 is a rotation bearing of the axis 5.1; and

5.3—tension pulley of the resilient elements (UE) of the bow.

6 is a rigid (non-deformable) bow body;

7 is a resilient element (UE) a potential energy storage (NPE) of the bow;

8 is a bowstring; and

9 is a tension cable, resilient element (UE).

10 is a stopper release cable.

DETAILED DESCRIPTION OF THE INVENTION

Figure 1A:
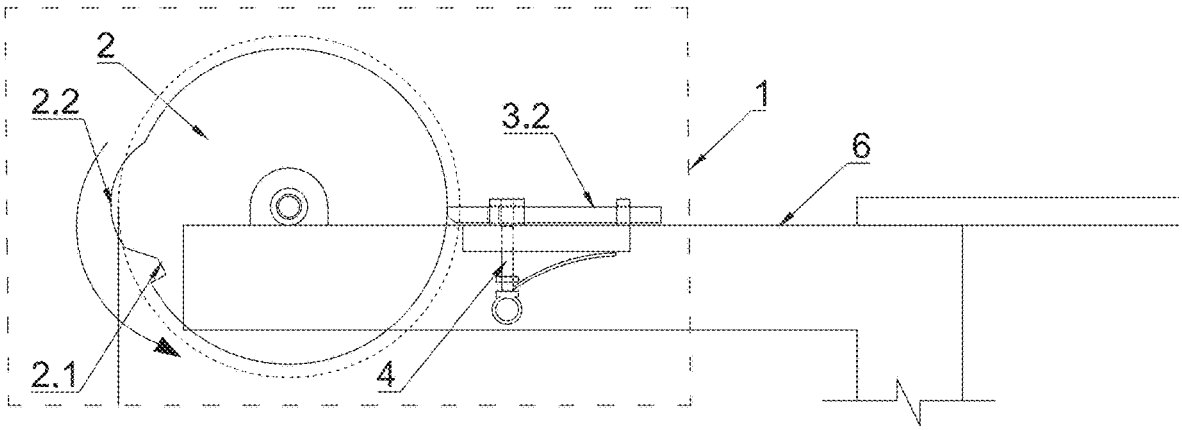
Figure 1B:
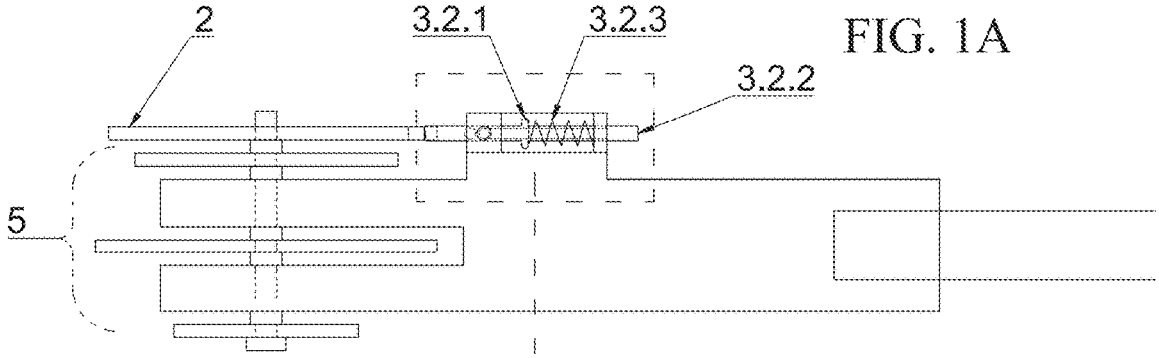
Figure 1C:
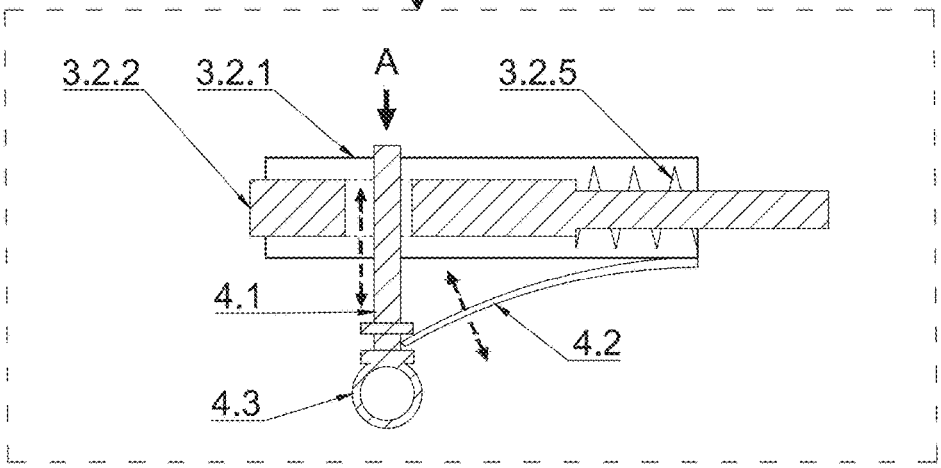
Figure 1D:
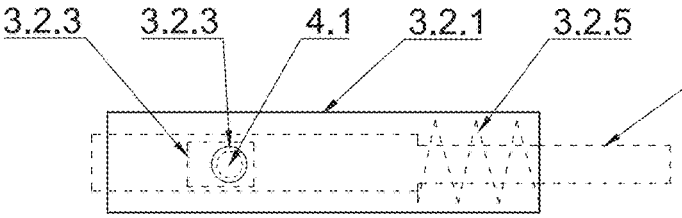
Figure 2A:
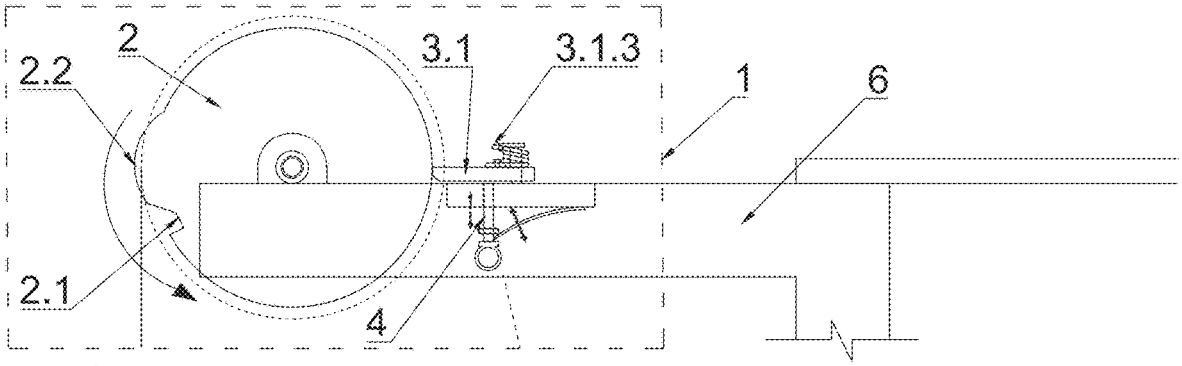
Figure 2B:
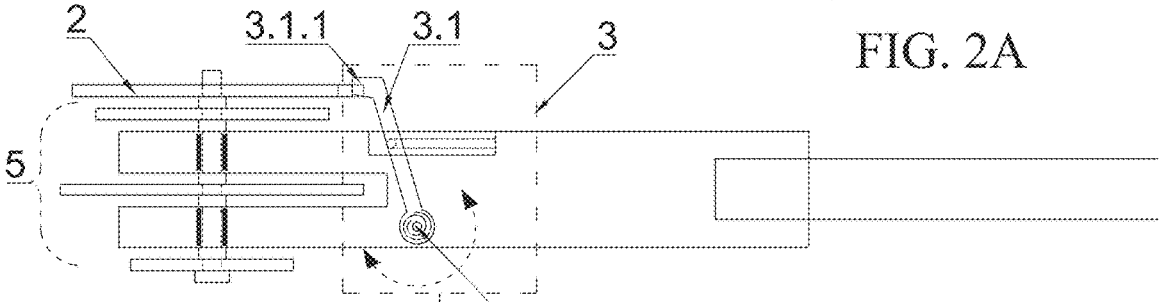
Figure 2C:
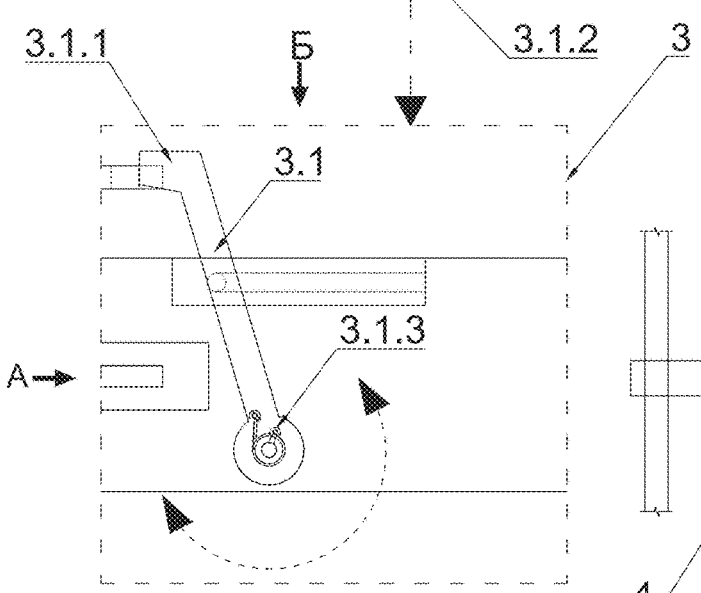
Figure 2D:
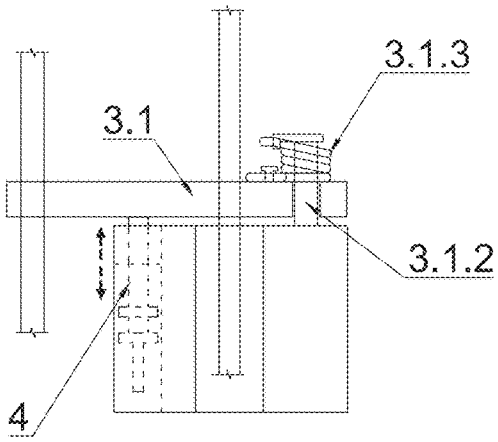
Figure 2E:
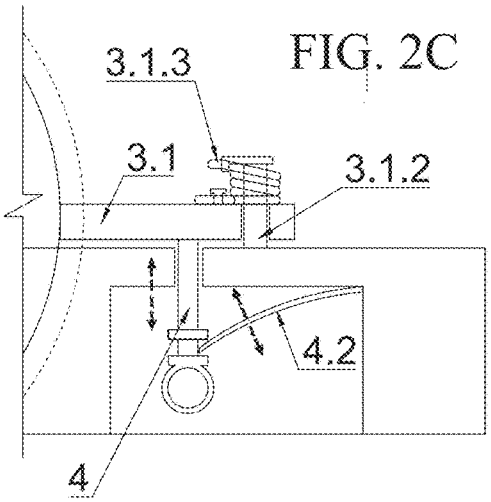
FIG. 2E is another view of the hitch lock (FZ).
Figure 3:
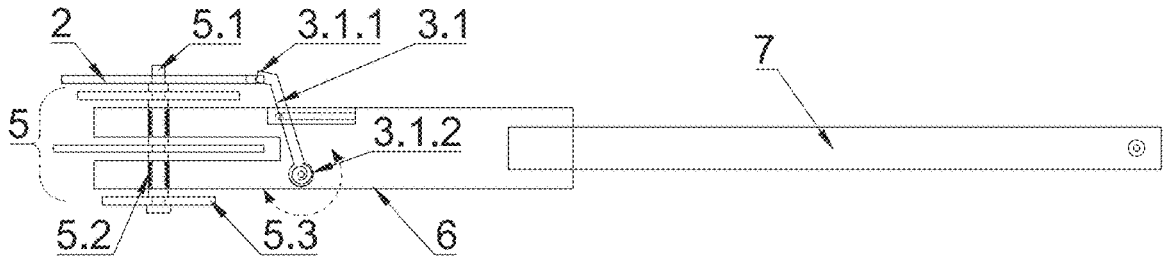
FIGS. 3 and 4 are top and side views, respectively, of the tension fixation device (UFN) with the hitch lock (FZ) in the form of a spring-loaded rotary lever or a pivot arm (PPR) with the resilient elements (UE) in the un-tensioned/un-stretched (Ep=0) position.
Figure 4:
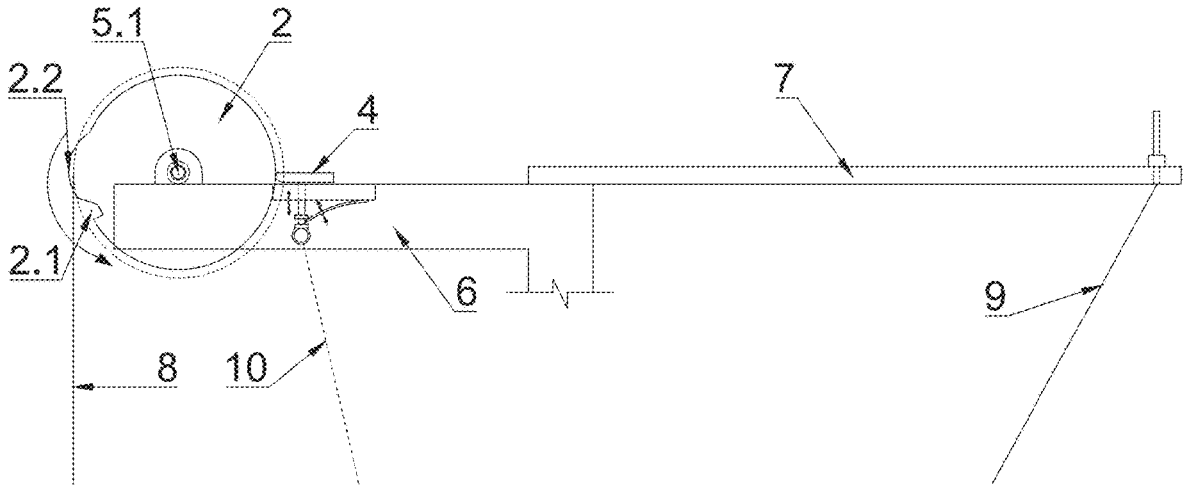
Figure 5:
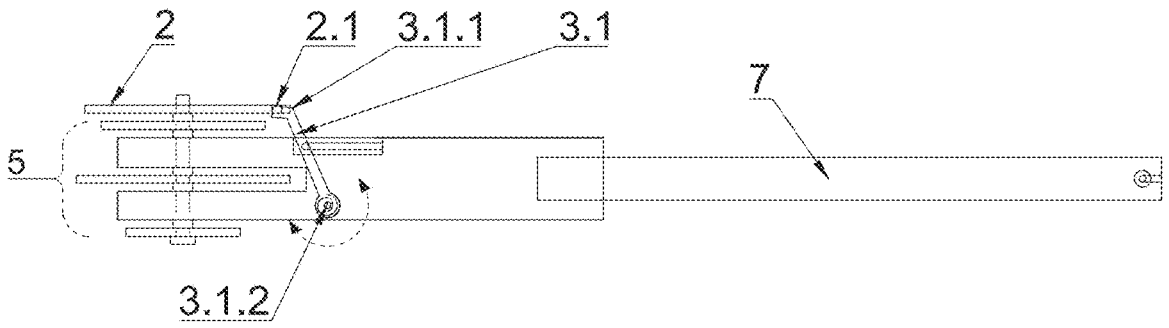
FIGS. 5 and 6 are top and side views, respectively, of the of the tension fixation device (UFN) with the hitch lock (FZ) in the form of a spring-loaded rotary lever or a pivot arm (PPR) in the position of the engagement and fixation of the potential energy (Ep) of the tension of the resilient elements (EE) of the bow.
Figure 6:
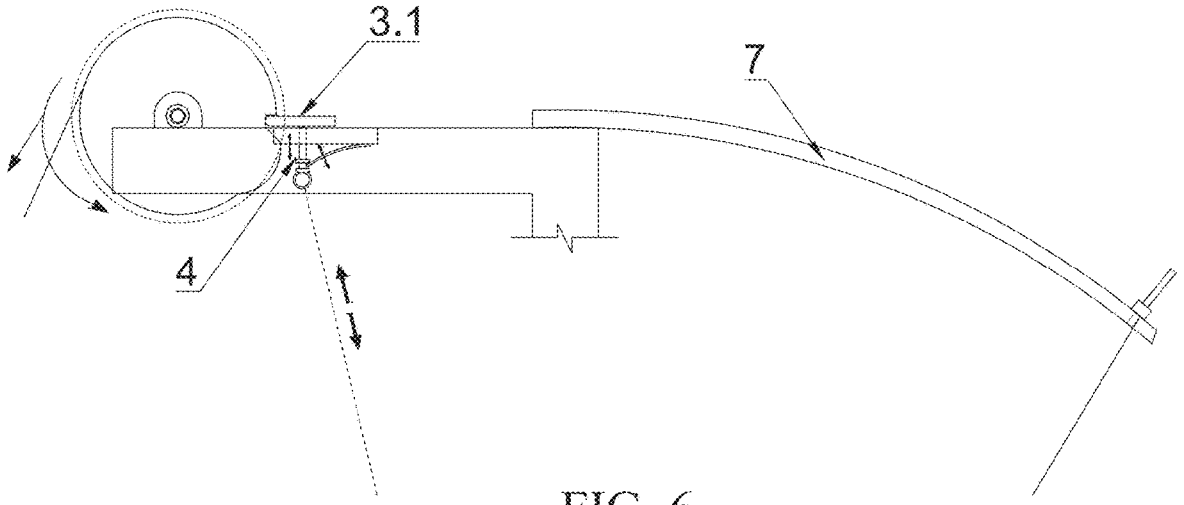
Figure 7:
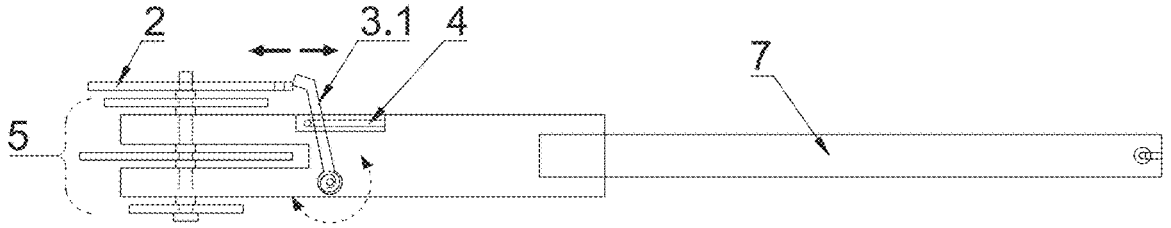
FIGS. 7 and 8 are top and side views, respectively, of the tension fixation device (UFN) with the with the hitch lock FZ in the form of a spring-loaded rotary lever or a pivot arm (PPR) at the moment of their disengagement and further releasing the accumulated potential energy during firing of a shot.
Figure 8:
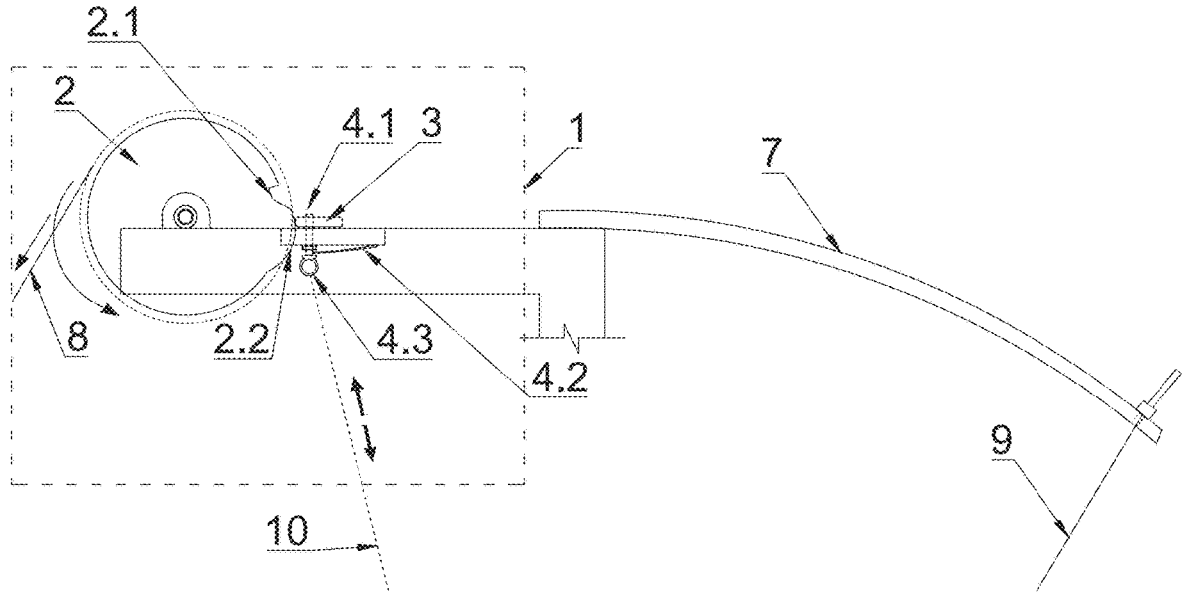
Figure 9:
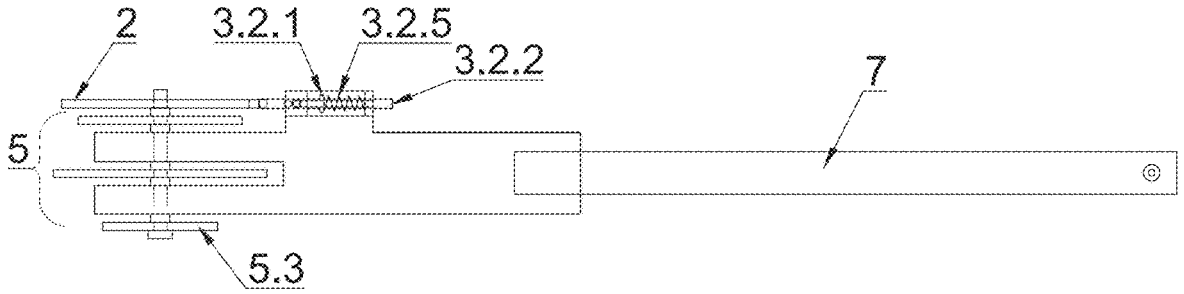
FIGS. 9 and 10 are top and side views, respectively, of the tension fixation device (UFN) with the hitch lock (FZ) in the form of a spring-loaded latch (PPZ) with the resilient elements (UE) in the straightened position (Ep=0).
Figure 10:
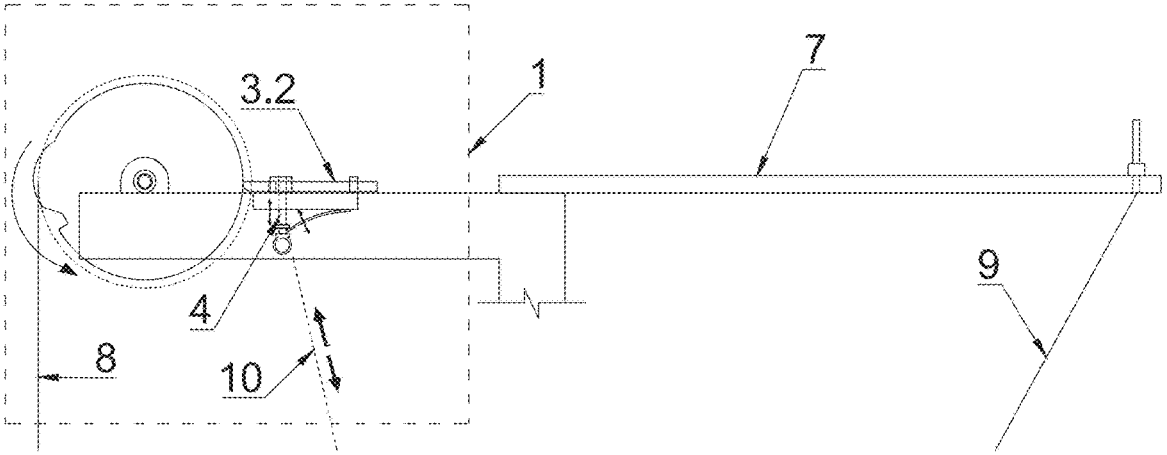
Figure 11A:
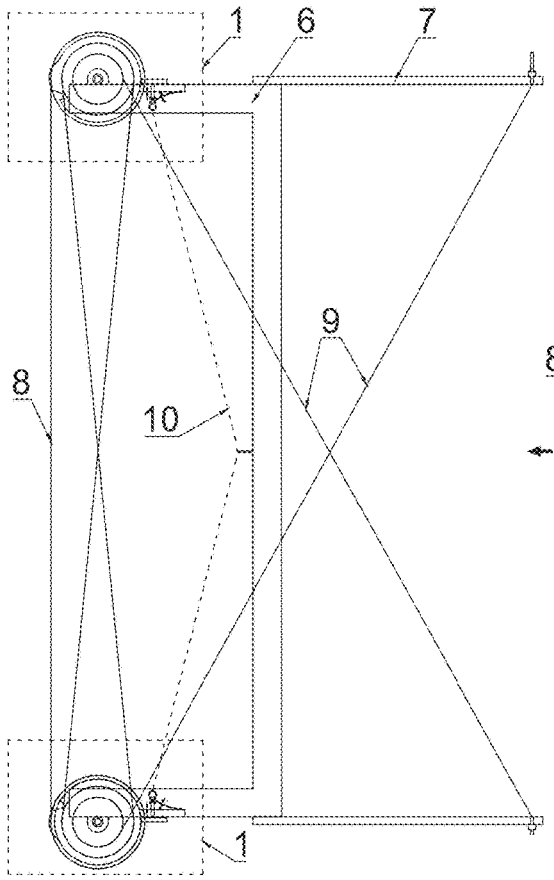
FIG. 11 illustrates the location and principle of operation of the tension fixation device (UFN) of flexible elements (UE) of the compound bow with an unstretched (a) and tensed (b) string, respectively.
Figure 11B:
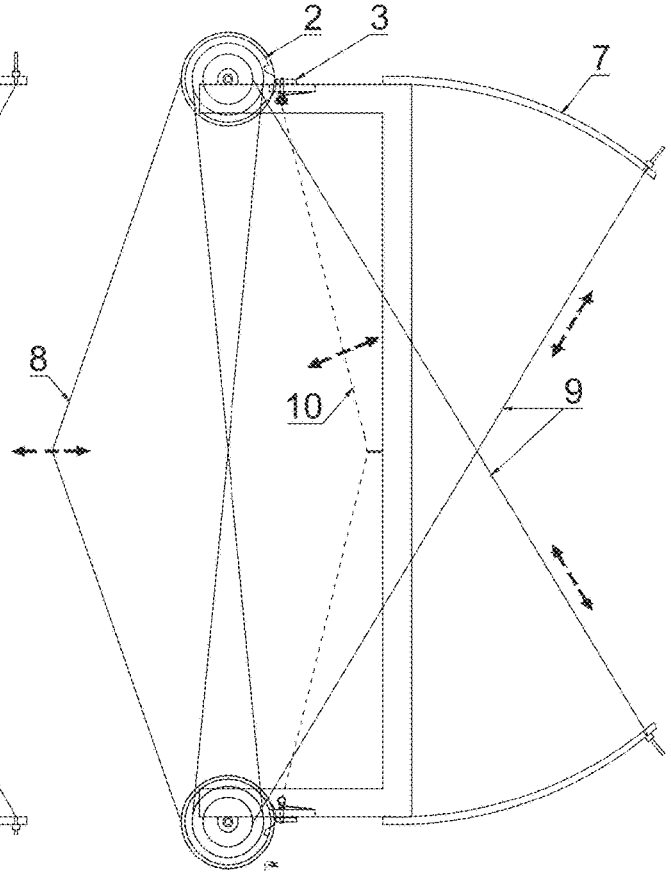

According to FIGS. 1-11, the tension fixation device 1 (UFN) of resilient or flexible elements (UE) 7 of the compound bow (BL) comprises the engaging device (ZU) 2, for installation on the blocks 5 tension pulleys (BNSh) of the bow and the hitch lock 3 (FZ) with a retainer stopper (SF) 4 for installation at the ends of the non-deforming bow body.

The above elements, namely the engaging device (ZU) 2 and hitch lock (FZ) 3, are formed capable of sequential engagement and release when the pulley block (BNSh) 5 rotates in one angular direction of the tension of the free ends of the resilient elements (UE) of the compound bow (BL). For this purpose, the engaging device (ZU) 2 is equipped with the engaging member 2.1 and a release 2.2, and the engaging device (FZ) 3 is equipped with the retainer stopper (SF) 4 for blocking the latch 3 in the tense position of the resilient elements (UE) of the compound bow (BL).

The engaging device (ZU) 2 provided in the form of a disk having the engaging member 2.1 and the release 2.2 which are made in the form of a recess and protrusion at the edge of the disk in the direction of rotation of the latter in the direction of tension of the resilient elements of the bow or in the form of the above-noted recess and protrusion provided directly at the edge of one of tension pulleys (BNSh) 5 in the above sequence.

The hitch lock_(FZ) 3 is made in the form of a spring-loaded rotary arm/lever (PPR) 3.1 or in the form of a spring-loaded latch (PPZ) 3.2.

The locking stop 4 of the retainer stopper (SF) is made in the form of a locking mechanism to hold the hitch lock (FZ) 3 in the disactivated state and contains a retractable pin 4.1

(ShV), equipped with the power spring 4.2 and the traction ring 4.3 for connecting the stop release cable.

It should be noted that the invention is not limited to the above-discussed example of the design of the tension fixation device (UFN) 1 of the resilient elements 7 of the compound bow.

According to the invention, another design of its functional elements is possible. In particular, the engagement device (ZU) 2 and the hitch lock (FZ) 3 can be made of metals and alloys, fiberglass, and various composites. As to the resilient element 3.2.5 of the working position of the hitch lock (FZ) 3 can be utilized springs made of spring steels, as well as rod membranes and torsion products made of resilient materials (not shown in the figures).

Operation of the Device for Fixing the Tension of the Resilient Elements

The tension fixation device (UFN) 1 of resilient elements (UE) 7 in the compound bow (FIG. 11) when providing the hitch lock (FZ) 3 in the form of a spring-loaded latch 3.2 (FIG. 1) and during shooting operates in the following manner.

Before firing the shot, the shooter by using the cable 10 connected to the pull ring 4.3 of the stopper 4, pulls back the retractable pin 4.1 of the retainer stopper (SF) 4 of each tension fixation device (UF) 1 located at opposite ends of the rigid body 2 of the bow.

The pulled retractable pin 4.1 releases the latch 3.2.2, which, under the action of the spring 3.2.5, is pressed against the surface of the engagement device (ZU) 2. After this, the shooter releases the cable 10.

After pressing the latch 3.2.2 to the surface of the engagement device (ZU) 2, the shooter pulls string 8. This rotates the pulleys of the pulley block (BPsh) 5 and rigidly connected with them engagement device (ZU) 2.

The rotating pulleys 5.3 of both arms of the bow wind the tension cables 9, connected to the free ends of flexible/resilient elements (UE) 7 of the bow around themselves.

By reducing the length of the cables 9, the flexible/resilient elements (UE) 7 are tensioned, and their potential compression energy is accumulated. When the required compression energy for the shot is reached, the recess 2.1 on the rotating surface of the engagement device (ZU) 2 engages with the end of the clamping latch 3.2.2 of the hitch lock (FZ) 3.2.

After the engagement of the engagement device (ZU) 2 accompanied the hitch lock (FZ) 3.2, sound of the click of the latch 3.2.2, the shooter stops the tension of the bowstring 9 and can release it. When the engagement device (ZU) 2 is engaged with the hitch lock (FZ) 3.2, the reverse rotation of the drive pulley (BPSh) 5 is stopped. Simultaneously the tension of the resilient elements (UE) 7 is automatically fixed with the potential energy specified according to the angular position of the engaging member 2.1 on the rotating surface of the engagement device (ZU) 2.

Next, the shooter places the arrow on the corresponding aiming shelf and aims at the expected meeting point of the arrow with the running target. This occurs without making any physical effort to hold the bowstring 8 in the tensioned position.

If a target appears in the bow's engagement zone, the shooter re-tensions the bowstring 8, by rotating the pulley (BPSh) 5 and overcoming the fixation force of the clamping latch 3.2.2 of the hitch lock_(FZ) 3.2 in the engaging member 2.1.

When the pulley (BPSh) 5 and the engagement device (ZU) 2 rotate, the clamping latch 3.2.2 runs into the uncoupling lug or the release 2.2 located on the surface of the engagement device (ZU) 2 directly after the engaging member 2.1 in the direction of rotation of the (ZU) 2 when the bowstring 8 is tensioned.

The clamping latch 3.2.2, pushed back by the release 2.2, engages (FIG. 1) with a spring-loaded pin 4.1 through the hole 3.2.3 in the latch 3.2.2. This result is unlocking of the engagement device (ZU) 2 with the hitch lock (FZ) 3.2. When the bowstring is lowered, the pulley (BPSh) 5 rotates freely and the kinetic energy of the resilient elements (UE) 7 is converted into the kinetic energy of the thrown arrow.

To carry out the next shot, the shooter uses the cable 10 to hold the traction ring 4.3 of the stopper 4 and releases the clamping latch 3.2.2 and the compound bow (BL) firing process is repeated.

In a similar manner, the tension fixation device (UFN) 1 of the resilient or flexible elements (UE) 7 of the compound bow operates when the hitch lock (FZ) 3 is made in the form of the hitch lock (FZ) 3.1 as a spring-loaded rotary arm (PPR).

The only difference is that in the engagement device 2 with the hitch lock (FZ) instead of a non-spring-loaded latch 3.2 there is provided a spring-loaded arm 3.1.

For single shooting at distant targets, flexible elements (UE) 7 in the compound bow can be tensioned by the shooter, by holding the string 8 with both hands and resting his feet against the bow body to lock the tension of the flexible elements (UE) 7 (not shown in the figures).

When the hitch lock (FZ) 3 is locked, the compound bow can operate in the free string tension mode without fixing the tension of the flexible elements (UE) 7, similar to a standard bow.

It has been discussed above that the invention provides the apparatus (1) for fixation or locking the tension of resilient elements (7) of a compound bow, which comprises a latch device (2) for mounting on tensioning pulleys (5) of the bow. A latch lock (3) is also provided with a lock detent (4) for mounting on the ends of the non-deformable body of the bow. The elements of the device (1), specifically the latch device (2) and the latch lock (3) are configured to be capable of being consecutively latched and released as the tensioning pulleys (5) rotate in one angular direction in which the free ends of the resilient elements (7) of the compound bow are tensioned. For this purpose, the latch device (2) is provided with a latch element (2.1) and a release element (2.2), and the latch lock (3) is provided with a detent (4) for locking the lock (3) in the tensioned position of the resilient elements (7) of the compound bow. In addition, the latch lock (3) is configured in the form of a spring-loaded pivot arm (3.1) or in the form of a spring-loaded slider (3.2). The lock detent (4) is configured in the form of a stopper mechanism for holding the latch lock (3) in a disengaged state and contains a retractable pin (4.1) provided with a power spring (4.2) and a pull ring (4.3) for connection of a detent release cable. The technical result achieved by the claimed device for locking the tension of the resilient members of a compound bow is that of reducing archer fatigue and increasing firing accuracy by making it possible to lock the resilient elements (7) of a compound bow in a tensioned position and to maintain said position prior to firing without using the hands.

The invention claimed is:

1. A device for fixation of tension of resilient elements of a compound bow, the compound bow including: (i) a non-deformable bow body; (ii) one or more resilient elements having tension cables connected to ends thereof; (iii) a bowstring; and (iv) a block of pulleys, disposed at ends of the non-deformable bow body and adapted to tension the tension cables and/or the bowstring, the device comprising:

an engagement device, formed as a disk fixed to the block of pulleys, the disk including a recess and protrusion adjacent one another and disposed at an edge of the disk;

a hitch lock adapted to be installed at an end of the non-deformable bow body; and a retainer stopper, mounted onto an end of the non-deformable bow body, the retainer stopper configured to prevent motion of the hitch lock until released, wherein, when the block of pulleys is rotated in a first angular direction to tension the one or more resilient elements, the engagement device is configured to rotate together with the block of pulleys, so that the hitch lock is sequentially engaged within and released from the recess, and wherein, when a desired tension is stored in the one or more resilient elements, the block of pulleys begins rotating in an opposite angular direction, the hitch lock is configured to engage and remain caught within the recess to prevent further rotation of the block of pulleys, enabling a user to release the tension from the bowstring while the tension in the bowstring is held.

2. The device according to claim 1, wherein the engagement device comprises a disk separate from the block of pulleys, and fixedly attached thereto by an engaging member, wherein the recess and the protrusion are disposed at the edge of the disk direction.

3. The device according to claim 1, wherein the hitch lock comprises a spring-loaded rotary arm.

4. The device according to claim 1, wherein the hitch lock comprises a spring-loaded latch.

5. The device according to claim 1, wherein the retainer stopper is configured to hold the hitch in a disabled state, and wherein the retainer stopper comprises a spring-loaded retractable pin and a traction ring functionally associated with a stopper unlocking cable for releasing the retainer stopper.

6. The device according to claim 1, wherein, following engagement of the engagement device and the hitch lock locking the tension, when the bowstring is pulled further, the engagement element is adapted to disengage from the hitch lock, thereby releasing the block of pulleys to rotate freely and enabling the tension stored in the one or more resilient elements to transfer to the bowstring for launching an arrow associated therewith.

7. The device according to claim 1, wherein one of the pulleys in the block of pulleys is disk shaped and functions as the disk of the engagement device, such that the recess and the protrusion are formed in the edge of the one of the pulleys.

8. A method of using a compound bow having at least one device according to claim 1 mounted thereon, the method comprising:

a. retracting the retainer stopper of each of the at least one device;

b. causing pulleys of the block of pulleys to rotate, together with the engagement device, in the first angular direction, thereby tensioning the tension cables connected to the at least one resilient element and accumulating potential energy in the at least one resilient element;

c. upon accomplishing a desired tension in the tension cables, allowing the block of pulleys to rotate in the opposite angular direction, causing the hitch lock to engage the engagement device and prevent further rotation of the block of pulleys; and d. removing manual pressure from the bowstring, while the bowstring remains tensioned.

9. The method of claim 8, further comprising the steps following the step d:

e. placing an arrow on an aiming shelf of the compound bow;

f. when the arrow is aimed at a target, causing the pulleys to rotate in the first angular direction, thereby to release the engagement device from the hitch lock and allow the energy accumulated in the at least one resilient element to be transferred, via the bowstring, to the arrow, to propel the arrow out of the compound bow.

10. A compound bow, comprising:

(i) a non-deformable bow body;

(ii) one or more resilient elements having tension cables connected to ends thereof;

(iii) a bowstring;

(iv) a block of pulleys, disposed at ends of the non-deformable bow body and adapted to tension the tension cables and/or the bowstring; and (v) the device according to claim 1.

* * * * *